US009134649B2

(12) United States Patent
Orihara et al.

(10) Patent No.: US 9,134,649 B2
(45) Date of Patent: Sep. 15, 2015

(54) IMAGE FORMING APPARATUS

(71) Applicant: CANON KABUSHIKI KAISHA, Tokyo (JP)

(72) Inventors: Tatsuaki Orihara, Tokyo (JP); Shuhei Tokiwa, Tokyo (JP); Kazunari Hagiwara, Yokohama (JP); Manami Haraguchi, Yokohama (JP); Makoto Fukatsu, Suntou-gun (JP); Atsushi Nakamoto, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/533,285

(22) Filed: Nov. 5, 2014

(65) Prior Publication Data

US 2015/0132028 A1 May 14, 2015

(30) Foreign Application Priority Data

Nov. 13, 2013 (JP) ..... 2013-235291

(51) Int. Cl.
*G03G 15/08* (2006.01)

(52) U.S. Cl.
CPC ..... *G03G 15/0812* (2013.01)

(58) Field of Classification Search
None
See application file for complete search history.

(56) References Cited

U.S. PATENT DOCUMENTS

| | | | | |
|---|---|---|---|---|
| 5,862,444 | A | 1/1999 | Machida et al. | |
| 6,463,245 | B1 * | 10/2002 | Suwa et al. | 399/274 |
| 7,233,758 | B2 | 6/2007 | Osada et al. | |
| 7,239,831 | B2 | 7/2007 | Hagiwara et al. | |
| 7,383,003 | B2 | 6/2008 | Kichijima et al. | |
| 7,764,910 | B2 | 7/2010 | Yamamoto et al. | |
| 8,204,412 | B2 | 6/2012 | Kubo et al. | |
| 2002/0172535 | A1 | 11/2002 | Aoki et al. | |
| 2013/0223891 | A1 | 8/2013 | Koyanagi et al. | |

FOREIGN PATENT DOCUMENTS

| | | | |
|---|---|---|---|
| JP | S57-066456 | A | 4/1982 |
| JP | H03-020764 | A | 1/1991 |
| JP | 07-031454 | B2 | 4/1995 |
| JP | 2005-326481 | A | 11/2005 |

OTHER PUBLICATIONS

Tatsuaki Orihara et al., U.S. Appl. No. 14/533,283, filed Nov. 5, 2014.
European Search Report dated Apr. 9, 2015, in related European Patent Application No. 14192770.7.

* cited by examiner

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

In an image forming apparatus having a photosensitive drum capable of carrying a toner image, a developing roller that is provided to be capable of rotating while carrying toner, and that supplies the toner to the photosensitive drum by contacting the photosensitive drum, a regulating blade that regulates a layer thickness of the toner carried on the developing roller, and a voltage applying device for applying a voltage to the developing roller and the regulating blade. The developing roller includes a conductive base layer and a surface layer covering the base layer, and a surface charge density of the developing roller is equal to or smaller than a surface charge density of the toner.

7 Claims, 10 Drawing Sheets

| FILM THICKNESS | DENSITY | Q/M |
|---|---|---|
| 10 | 1.0916 | 66.3 |
| 100 | 1.1004 | 59.8 |
| 500 | 1.08 | 70 |
| 1000 | 0.9938 | 93.3 |

IMAGE FORMING APPARATUS

BACKGROUND OF THE INVENTION

1. Field of the Invention

The present invention relates to an image forming apparatus.

2. Description of the Related Art

A conventional image forming apparatus using an electrophotographic system includes a photosensitive drum serving as an image bearing member, a developing roller serving as a developer carrying member, and a regulating blade that regulates a film thickness of toner (a developer) on the developing roller. In this image forming apparatus, a development process for visualizing a latent image formed on the photosensitive drum is performed by transferring the toner carried on the developing roller to the latent image. In a region (referred to hereafter as a non-image portion) of the photosensitive drum where the toner is not to be transferred, within a contact region (referred to hereafter as a developing nip portion) where the photosensitive drum contacts the developing roller, a voltage is applied so that a force generated by the toner traveling from the photosensitive drum toward the developing roller is received.

Here, non-image portion contamination (referred to hereafter as fog) may occur when the toner is transferred to the non-image portion of the photosensitive drum, where the toner is not intended to be transferred. Fog is generated when a charge of the toner decays or a polarity of the toner reverses in the developing nip portion where the photosensitive drum contacts the developing roller. It is known that a charge-providing performance in relation to the toner deteriorates particularly in a high humidity environment. When the charge-providing performance in relation to the toner deteriorates, the charge of the toner decays, leading to an increase in the amount of fog.

Japanese Patent Publication No. H7-31454 proposes setting a volume resistance of the developing roller at or above a predetermined value in order to suppress the occurrence of fog in which toner is transferred onto a non-image portion of a photosensitive drum.

SUMMARY OF THE INVENTION

It has been found, however, that decay of the toner charge occurs not only in the developing nip portion where the photosensitive drum contacts the developing roller, but also in a regulating nip portion where the regulating blade contacts the developing roller. Furthermore, fog is also dependent on a circumferential speed of the developing roller, a voltage applied to the regulating nip portion, and so on. These elements have an extremely large effect, and it has been found to be impossible to suppress fog with stability over time using the method proposed in Japanese Patent Publication No. H7-31454. Moreover, when the volume resistance of the developing roller is simply increased, a development performance deteriorates due to a reduction in density and so on.

Hence, in consideration of the problems described above, an object of the present invention is to suppress the occurrence of fog while maintaining a favorable development performance.

To achieve this object, an image forming apparatus according to the present invention comprising:

an image bearing member capable of bearing a developer image that is formed by supplying a developer to a latent image formed on a surface thereof;

a developer carrying member that is provided to be capable of rotating while carrying the developer, and that supplies the developer to the image bearing member by contacting the image bearing member;

a regulating member that regulates a layer thickness of the developer carried on the developer carrying member; and voltage applying device for applying a voltage to the developer carrying member and the regulating member, wherein the developer carrying member includes a conductive base layer and a surface layer covering the base layer, and when a volume resistance of the surface layer is $\rho c$, a film thickness thereof is dc, and a relative dielectric constant thereof is $\in c$, a surface charge density of the developer on the developer carrying member, the film thickness of which has been regulated by the regulating member, is q/s, a relative dielectric constant thereof is $\in t$, and a layer thickness thereof is dt, a potential difference between the developer carrying member and the regulating member is V, and a time required for the developer to pass through a contact region between the developer carrying member and the regulating member after entering the contact region as the developer carrying member rotates is T, $$\left|\frac{VT}{\rho_c d_c}\right| \leq \left|\frac{q}{s}\right|$$

$$\frac{d_c}{\varepsilon_c} \leq \frac{d_t}{\varepsilon_t}$$

is satisfied.

According to the present invention, the occurrence of fog can be suppressed while maintaining a favorable development performance.

Further features of the present invention will become apparent from the following description of exemplary embodiments with reference to the attached drawings.

DESCRIPTION OF THE EMBODIMENTS

Embodiments of the present invention will be described using examples with reference to the drawings. Dimensions, materials and shapes of the components and relative configurations thereof according to the embodiments should be appropriately changed in accordance with the configuration and various conditions of the apparatus to which the invention is applied. In other words, the following embodiments are not intended to limit the scope of the present invention.

Figure 1:
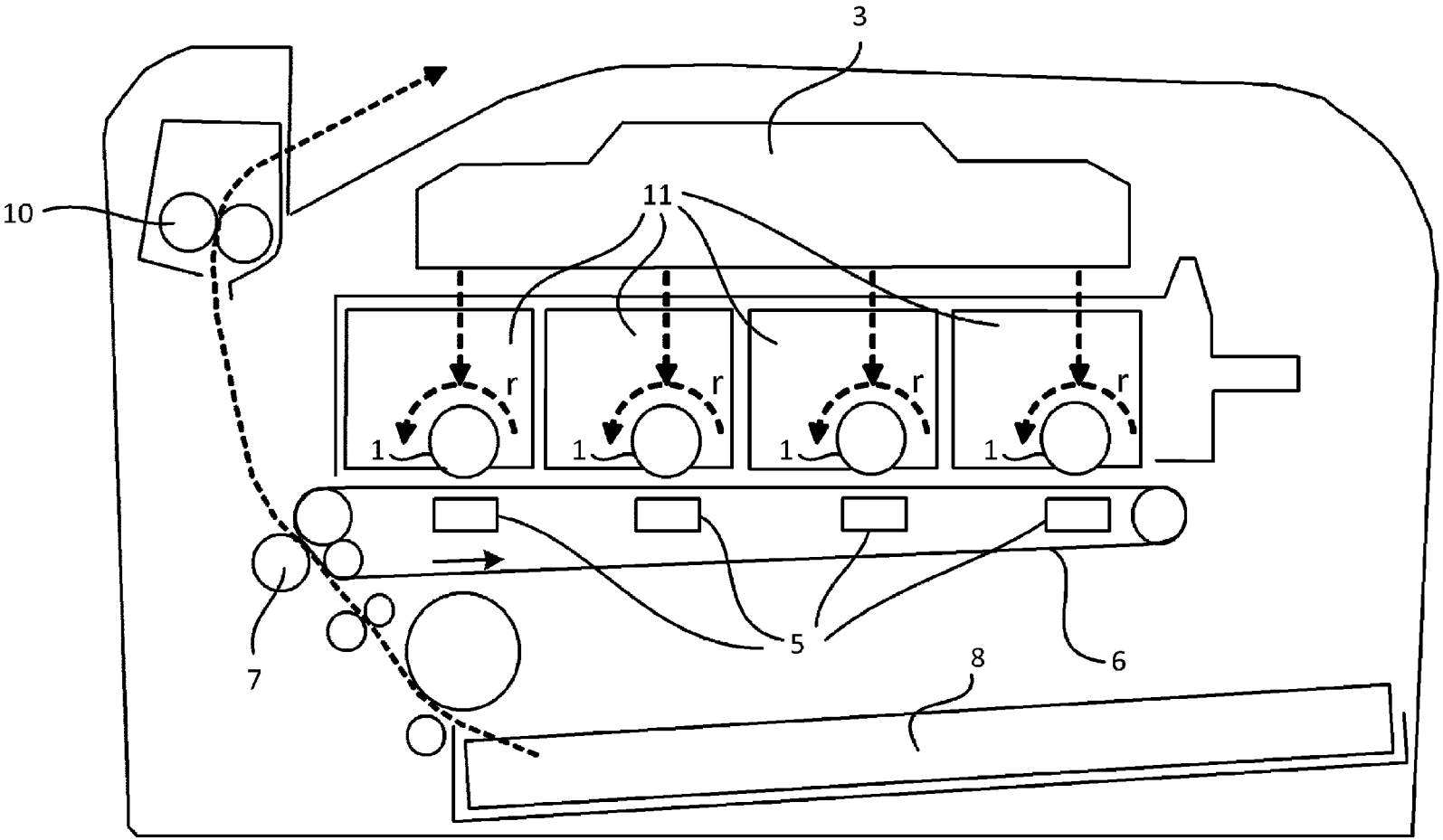
FIG. 1 is a schematic sectional view showing a configuration of an image forming apparatus according to an embodiment.
Figure 2:
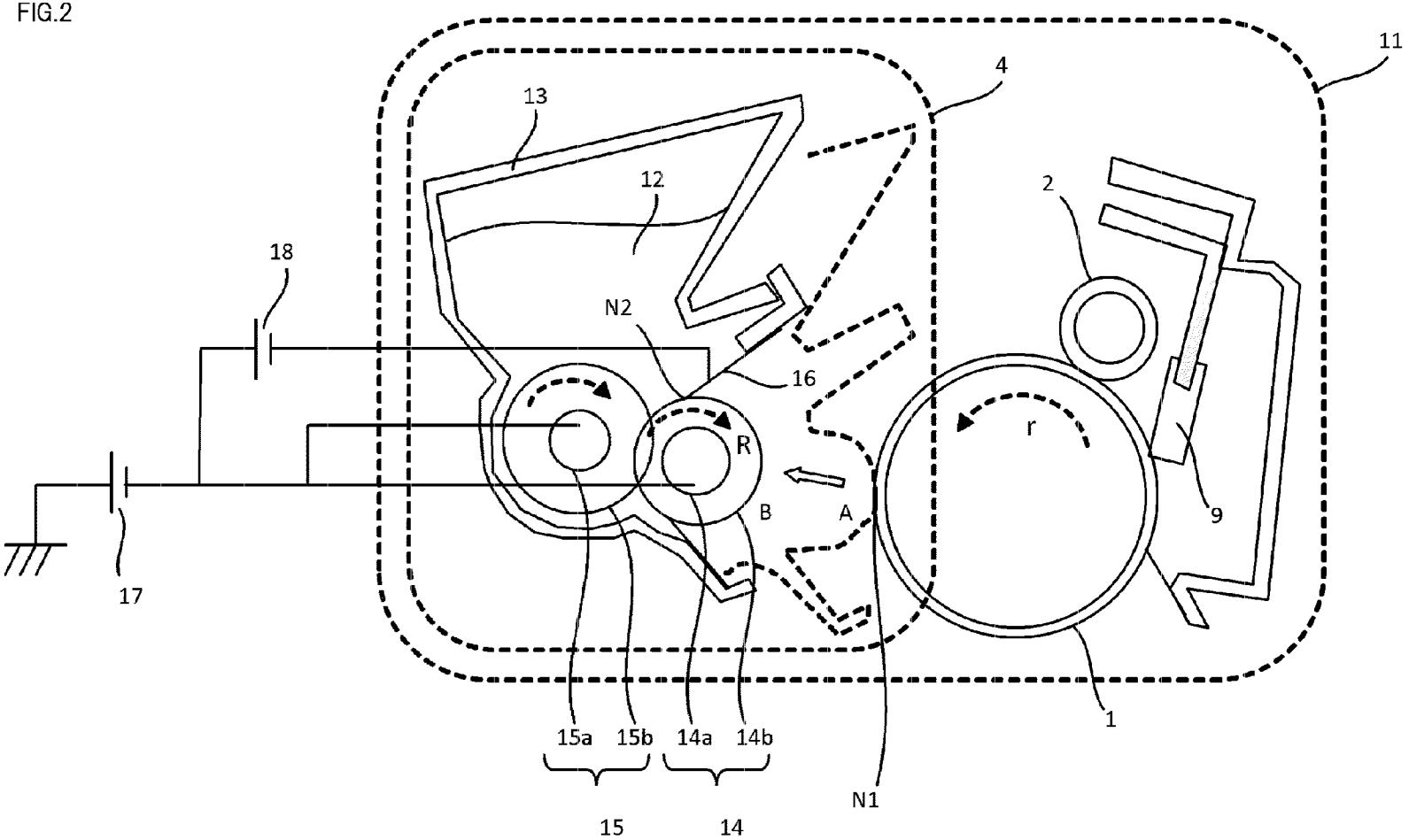
FIG. 2 is a schematic sectional view showing a configuration of a cartridge according to this embodiment.

Referring to FIGS. 1 and 2, an embodiment (referred to hereafter as this embodiment) of the present invention will be described. FIG. 1 is a schematic sectional view showing a configuration of an image forming apparatus according to this embodiment. FIG. 2 is a schematic sectional view showing a configuration of a cartridge according to this embodiment.

As shown in FIG. 1, the image forming apparatus includes a laser optical apparatus 3 serving as an exposure device, a primary transfer apparatus 5, an intermediate transfer member 6, a secondary transfer apparatus 7, and a fixing apparatus 10. The image forming apparatus also includes a process cartridge (referred to hereafter simply as a cartridge) 11 that performs an image forming process and can be attached to and detached from an apparatus main body. As shown in FIG. 2, a photosensitive drum 1 serving as an image bearing member capable of bearing a latent image, a charging roller 2 serving as a charging device, a developing assembly 4, and a cleaning blade 9 are formed integrally in the cartridge 11.

The photosensitive drum 1 is provided to be capable of rotating in a direction of an arrow r in FIG. 2, and a surface of the photosensitive drum. 1 is charged to a uniform surface potential (a dark potential) Vd by the charging roller 2 (a charging process). By emitting a laser beam from the laser optical apparatus 3, an electrostatic latent image is formed on the surface of the photosensitive drum 1 (an exposure process). A potential of the electrostatic latent image at this time is a light potential Vl. Further, by supplying toner from the developing assembly 4 as a developer, the electrostatic latent image is visualized as a toner image serving as a developer image (a development process).

The visualized toner image on the photosensitive drum 1 is transferred onto the intermediate transfer member 6 by the primary transfer apparatus 5, and then transferred onto a sheet 8 serving as a recording medium by the secondary transfer apparatus 7 (a transfer process). Here, untransferred toner that remains on the photosensitive drum 1 having not been transferred in the transfer process is scraped away by the cleaning blade 9 (a cleaning process). After the surface of the photosensitive drum 1 has been cleaned, the charging process, exposure process, development process, and transfer process described above are repeated. Meanwhile, the toner image transferred onto the sheet 8 is fixed by the fixing apparatus 10, whereupon the sheet 8 is discharged to the exterior of the image forming apparatus.

In this embodiment, the apparatus main body is provided with four attachment portions to which the cartridge 11 is attached. Cartridges 11 filled respectively with yellow, magenta, cyan, and black toner are attached in order from an upstream side of a movement direction of the intermediate transfer member 6, and a color image is formed by transferring the toner in the respective colors in sequence onto the intermediate transfer member 6.

The photosensitive drum 1 is formed by laminating an organic photoreceptor that uses arylate as a charge transport layer onto an Al (aluminum) cylinder serving as a conductive substrate. The charging roller 2 is formed by providing a semiconductive rubber layer on a core metal serving as a conductive support member. The charging roller 2 exhibits a resistance of approximately $10^5\Omega$ when a voltage of 200 V is applied to the conductive photosensitive drum 1.

As shown in FIG. 2, the developing assembly 4 includes a developer container 13, a developing roller 14 serving as a developer carrying member capable of carrying toner, a supply roller 15, and a regulating blade 16 serving as a regulating member. Toner 12 serving as a developer is housed in the developer container 13. The developing roller 14 is provided to be capable of rotating in a direction of an arrow R in FIG. 2. The supply roller 15 supplies the toner 12 housed in the developer container 13 to the developing roller 14. The regulating blade 16 regulates a film thickness of the toner on the developing roller 14 (on the developer carrying member). Further, the supply roller 15 is provided to be capable of rotating while contacting the developing roller 14, and one end of the regulating blade 16 contacts the developing roller 14. Hereafter, a contact region between the photosensitive drum 1 and the developing roller 14 will be referred to as a developing nip portion N1, and a contact region between the regulating blade 16 and the developing roller 14 will be referred to as a regulating nip portion N2.

Here, as shown in FIG. 2, the developing assembly 4 is capable of performing a contact/separation operation relative to the photosensitive drum 1. More specifically, the developing assembly 4 is provided to be capable of moving between a contact position A (a position indicated by dotted lines in FIG. 2) contacting the photosensitive drum 1 and a separation position B (a position indicated by solid lines in FIG. 2) separated from the photosensitive drum 1 (i.e. to be capable of contacting and separating from the photosensitive drum 1). The contact position A is a position in which to perform a development operation, and the separation position B is a position in which to prevent the toner 12 from deteriorating and the photosensitive drum 1 from becoming worn due to rubbing against the photosensitive drum 1. When image formation is not underway, the developing assembly 4 is adjusted appropriately so as to separate from the photosensitive drum 1 to prevent the toner 12 from rubbing against the photosensitive drum 1 such that the toner 12 deteriorates and the photosensitive drum 1 becomes worn.

The toner 12 used in this embodiment is a single component, non-magnetic toner and a negatively charged toner that is charged to a negative polarity during development. Image formation is performed using a reversal development system in which the photosensitive drum 1 is likewise charged to a negative polarity such that the toner 12 adheres to an exposed portion exposed by the laser optical apparatus 3. Note that a particle diameter of the toner 12 is approximately 5 μm.

The developing roller 14 is formed by providing a silicon rubber layer 14*b* serving as a conductive base layer containing a conductive agent on a periphery of a core metal electrode 14*a* having an outer diameter of ϕ 6 (mm) and serving as a conductive support member. A surface layer of the silicon rubber layer 14*b* is coated with urethane resin through which roughening particles and a conductive agent are dispersed, whereby an overall outer diameter of the developing roller 14 is set at ϕ 11.5 (mm).

The supply roller 15 is formed by providing a urethane foam layer 15*b* around a core metal electrode 15*a* that has an outer diameter of ϕ 5.5 (mm) and serves as a conductive support member. An overall outer diameter of the supply roller 15, including the urethane foam layer 15*b*, is ϕ 13 (mm). A penetration level of the developing roller 14 relative to the supply roller 15 is 1.2 mm. In a contact region between the supply roller 15 and the developing roller 14, the supply roller 15 and the developing roller 14 rotate in directions having mutually opposite direction speeds.

A powder pressure of the toner 12 existing on the periphery of the urethane foam layer 15*b* acts on the urethane foam layer 15*b*, and when the supply roller 15 rotates, the toner 12 penetrates the urethane foam layer 15*b*. The supply roller 15 containing the toner 12 supplies the toner 12 to the developing roller 14 in the contact region with the developing roller 14, and by rubbing against the toner 12, applies a preliminary triboelectric charging charge to the toner 12. The charged toner 12 supplied to the developing roller 14 adheres firmly to the developing roller 14 and moves toward the regulating blade 16.

The regulating blade 16 is an SUS (stainless steel) blade having a thickness of 80 μm, and is disposed in a reverse orientation (in a counter direction) to the rotation of the developing roller 14. A layer thickness of the toner 12 on the developing roller 14 is uniformly regulated by the regulating blade 16. Further, the toner 12 obtains a desired triboelectric charging charge by rubbing against the regulating blade 16. The toner 12 on the developing roller 14 that passes the regulating blade 16 is provided for development in the developing nip portion N1 with the photosensitive drum 1, while the toner 12 that is not developed is peeled away by the supply roller 15.

A voltage for setting a developing bias Vdc is applied to the developing roller 14 by voltage applying device 17, 18. The supply roller 15 is set at an equal potential to Vdc. −200 V is applied to the regulating blade 16 relative to the developing roller 14. This potential difference in the potentials applied to the developing roller 14 and the regulating blade 16 is required to stabilize coating of the toner 12, and is applied with polarization in a direction in which the toner, when charged normally, is pressed against the developing roller 14. An absolute value of the potential difference serves as the blade bias V.

First Example

The developing roller 14 was manufactured to have features described below and set as a developing roller A. An example in which the developing roller A is applied to the image forming apparatus according to this embodiment serves as a first example.

The silicon rubber layer 14*b* serving as the conductive base layer containing a conductive agent was provided on the periphery of the core metal electrode 14*a* having an outer diameter of ϕ 6 (mm) and serving as the conductive support member. The surface layer of the silicon rubber layer 14*b* was coated with 10 μm of urethane resin through which roughening particles and a conductive agent were dispersed, whereby the overall outer diameter of the developing roller A was set at ϕ 11.5 (mm). Furthermore, an Al2O3 layer of 100 nm (0.1 μm) was provided as a surface layer by electron beam deposition. When the silicon rubber layer, the urethane resin, and the Al2O3 layer were cut out integrally and 200 V was applied thereto in a thickness direction, a resistance of the developing roller A was approximately $10^9$ Ωcm$^2$. Further, a volume resistance ρc of the Al2O3 layer was approximately $10^{14}$ Ωcm.

First Comparative Example

The developing roller 14 was manufactured to have features described below and set as a developing roller B. An example in which the developing roller B is applied to the image forming apparatus according to this embodiment serves as a first comparative example.

The conductive silicon rubber layer 14*b* containing a conductive agent was provided on the periphery of the core metal electrode 14*a* having an outer diameter of ϕ 6 (mm) and serving as the conductive support member. The surface layer of the silicon rubber layer 14*b* was coated with 10 μm of urethane resin through which roughening particles and a conductive agent were dispersed to form the surface layer, whereby the overall outer diameter of the developing roller B was set at ϕ 11.5 (mm). When the silicon rubber layer and the urethane resin were cut out integrally and 200 V was applied thereto in the thickness direction, the resistance of the developing roller B was approximately $10^7$ Ωcm$^2$. Further, the volume resistance ρc of the urethane layer was approximately $10^8$ Ωcm.

Second Comparative Example

The developing roller 14 was manufactured to have features described below and set as a developing roller C. An example in which the developing roller C is applied to the image forming apparatus according to this embodiment serves as a second comparative example.

The conductive silicon rubber layer 14*b* containing a conductive agent was provided on the periphery of the core metal electrode 14*a* having an outer diameter of ϕ 6 (mm) and serving as the conductive support member. The surface layer of the silicon rubber layer 14*b* was coated with 10 μm of urethane resin through which roughening particles and a conductive agent were dispersed, whereby the overall outer diameter of the developing roller C was set at ϕ 11.5 (mm). Furthermore, an Al2O3 film of 1 μm was provided as the surface layer by electron beam deposition. When the silicon rubber layer, the urethane resin, and the Al2O3 film were cut out integrally and 200 V was applied thereto in a thickness direction, a resistance of the developing roller C was approximately $10^{10}$ Ωcm$^2$. Further, a volume resistance ρc of the Al2O3 film was approximately $10^{14}$ Ωcm. This example corresponds to the first example in which the film thickness of the Al2O3 layer has been increased.

Third Comparative Example

The developing roller 14 was manufactured to have features described below and set as a developing roller D. An example in which the developing roller D is applied to the image forming apparatus according to this embodiment serves as a third comparative example.

The conductive silicon rubber layer 14*b* containing a conductive agent was provided on the periphery of the core metal electrode 14*a* having an outer diameter of ϕ 6 (mm) and serving as the conductive support member. The surface layer of the silicon rubber layer 14*b* was coated with 10 μm of urethane resin through which roughening particles and a conductive agent were not dispersed to form the surface layer, whereby the overall outer diameter of the developing roller D was set at ϕ 11.5 (mm). When the silicon rubber layer and the urethane resin were cut out integrally and 200 V was applied thereto in the thickness direction, the resistance of the developing roller D was approximately $10^8$ Ωcm$^2$. Further, the volume resistance of the urethane was approximately $10^{10}$ Ωcm. This example corresponds to the first example in which the resistance of the urethane layer has been increased, and therefore corresponds to Japanese Patent Publication No. H7-31454 (Patent Document 1).

Note that the surface layer is the outermost layer formed on the surface of the developing roller 14, i.e. the layer that contacts the toner. According to the present invention, as long as the internal structure other than the outermost layer is constituted by at least one layer, similar effects can be obtained. In these examples, aluminum oxide was used as the surface layer, but the surface layer may be formed using a type of alumina other than aluminum oxide. The alumina is an aluminum oxide such as α alumina or γ alumina, an aluminum oxide hydrate such as Boehmite or pseudo-Boehmite, aluminum hydrate, or an aluminum compound obtained by subjecting aluminum alkoxide to hydrolysis and a condensation reaction.

The aim of the surface layer is to prevent charge leakage, and as long as a function for preventing charge leakage is provided on a certain layer, the surface layer may be set as desired. Further, when an average volume resistance of the entire roller is estimated for each of the developing rollers A, B, C, D used in the first example and the first, second, and third comparative examples, all of the average volume resistances satisfy ($\rho > 7\times10^6$), as proposed in Patent Document 1.

(Evaluation)

An amount of fog on the photosensitive drum 1 was investigated using the developing rollers A, B, C, D according to the first example and the first, second, and third comparative examples. Further, an image was output, and a density and a residual image were evaluated as the development performance.

<Evaluation Conditions>

Table 1 shows evaluation conditions. Unless specified otherwise, evaluation was performed in a high-temperature, high-humidity environment of 30° C. and 80% RH, in which fog is generated easily.

TABLE 1

| Developing roller | Surface layer: Material | Film thickness $d_c$ (μm) | Relative dielectric constant $\epsilon_c$ | Volume resistance $\rho_c$ (Ωcm) | Volume resistance above silicon rubber layer $\rho$ (Ωcm) |
|---|---|---|---|---|---|
| A | Al2O3 | 0.1 | 10 | $10^{14}$ | $10^9$ |
| B | Urethane with roughening particles and conductive agent | 10 | 7 | $10^8$ | $10^7$ |
| C | Al2O3 | 1 | 10 | $10^{14}$ | $10^{10}$ |
| D | Urethane | 10 | 7 | $10^{10}$ | $10^8$ |

| Developing roller | Vback (V) | Toner layer thickness $d_t$ (μm) | Toner layer relative dielectric constant $\epsilon_t$ | Blade bias V (V) | Circumferential speed (mm/s) | Regulating nip width (mm) | Nip width passage time T (ms) |
|---|---|---|---|---|---|---|---|
| A | 500 | 10 | 2 | 200 | 69 | 0.4 | 5.8 |
| B | | | | | | | |
| C | | | | | | | |
| D | | | | | | | |

The penetration level of the developing roller 14 into the photosensitive drum 1 in the developing nip portion N1 is set at 40 μm by a roller, not shown in the drawings, provided on an end portion of the developing roller 14. In the developing nip portion N1, the developing roller 14 rotates in an identical direction (the R direction) to the rotation direction (the r direction) of the photosensitive drum 1 at a circumferential speed ratio of 117% relative to the photosensitive drum 1. In other words, the photosensitive drum 1 is provided to be capable of rotating such that a surface movement direction thereof in the developing nip portion N1 is identical to the developing roller 14, while the developing roller 14 rotates at a higher rotation speed than the photosensitive drum 1. This circumferential speed difference is provided in order to apply a shearing force to the toner, thereby reducing a substantive attachment force thereof so that controllability by means of an electric field is improved.

Further, the blade bias V is set at 200 V, and the width of the regulating nip portion N2 (the length of the regulating nip portion N2 in the rotation direction of the developing roller 14; to be referred to hereafter as the regulating nip width) is set at 0.4 mm. The passage time T through the regulating nip portion N2 is obtained from the circumferential speed of the developing roller 14 and the regulating nip width. The passage time T is a time required for the developer to pass through the regulating nip portion N2 (the contact region between the regulating blade 16 and the developing roller 14) after entering the regulating nip portion N2.

The surface potential of the photosensitive drum 1 in an unexposed condition is set as the dark potential Vd, and |Vd−Vdc| is set as Vback. During the fog evaluation, Vback was set at 500 V. Further, the respective relative dielectric constants were determined from impedance measurements obtained using a 1260 type impedance analyzer and a 1296 type impedance analyzer, manufactured by Solartron.

The fog amount was measured using a following method. First, fog on the photosensitive drum 1 was transferred onto transparent polyester tape, whereupon the tape was adhered to a commercial 4200 sheet manufactured by XEROX. Next, a reflection density was measured using a reflection density gauge manufactured by GretagMacbeth. The measurement was performed simply by subtracting a measurement value of a part of the sheet to which the tape was adhered. As regards the charge amount of the toner 12, first, surface charge densities of individual toner samples 12 were measured using an E-spart analyzer, manufactured by Hosokawa Micron Group, whereupon an average value thereof was calculated and set as q/s.

<Evaluation Results>

Table 2 shows in list form whether or not the respective developing rollers satisfy the proposals of Patent Document 1 and several relational expressions, and whether or not fog and the development performance are satisfactory. It can be seen that although all of the developing rollers satisfy the proposals of Patent Document 1, large differences exist in fog.

TABLE 2

| Developing roller | Volume resistance above silicon rubber layer ρ (Ωcm) | $VT/\rho_c d_c$ (μC/m²) | Toner q/s (μC/m²) | $d_c/\epsilon_c$ (μm) | $d_t/\epsilon_t$ (μm) | Surface layer film thickness $d_c$ (μm) |
|---|---|---|---|---|---|---|
| A | $10^9$ | 11.6 | −32 | 0.01 | 5 | 0.1 |
| B | $10^7$ | $1.2 \times 10^5$ | −24 | 1.4 | 5 | 10 |
| C | $10^{10}$ | 1.2 | | 0.1 | 5 | 1 |
| D | $10^8$ | $1.2 \times 10^3$ | −38 | 1.4 | 5 | 10 |

| Developing roller | $\rho > 7 \times 10^6$ (Ωcm) (Patent Document 1) | $\lvert VT/\rho_c d_c \rvert < \lvert q/s \rvert$ | $d_c/\epsilon_c < d_t/\epsilon_t$ | $d_c < 1$ μm | Fog (%) | Development performance |
|---|---|---|---|---|---|---|
| A | ○ | ○ | ○ | ○ | ○ 0.9 | ○ |
| B | ○ | X | ○ | X | X 26 | ○ |
| C | ○ | ○ | ○ | X | ○ | X |
| D | ○ | X | ○ | X | X 8.6 | ○ |

When the film thickness of the surface layer of the developing roller is set as dc, the dielectric constant thereof is set as ∈C, the thickness of the toner layer is set as dt, and the dielectric constant thereof is set as ∈t, the developing roller A according to the first example satisfies (Equation 1) to (Equation 3), shown below.

[Math. 1]

$$\left|\frac{VT}{\rho_c d_c}\right| \leq \left|\frac{q}{s}\right| \quad \text{(Equation 1)}$$

[Math. 2]

$$\frac{d_c}{\varepsilon_c} \leq \frac{d_t}{\varepsilon_t} \quad \text{(Equation 2)}$$

[Math. 3]

$$d_c < 1 \ \mu\text{m} \quad \text{(Equation 3)}$$

In the first example, these relational expressions are satisfied, and therefore reversal fog can be suppressed dramatically, leading to an overall improvement in fog. Further, the printed image is a favorable image not exhibiting problems relating to density, after-image, and so on.

The developing roller B according to the first comparative example does not satisfy (Equation 1), and therefore a large amount of fog was observed. The developing roller C according to the second comparative example does not satisfy (Equation 3), and therefore problems relating to density and after-image were observed. The developing roller D according to the third comparative example does not satisfy (Equation 1), and therefore a large amount of fog was observed.

Figure 3:
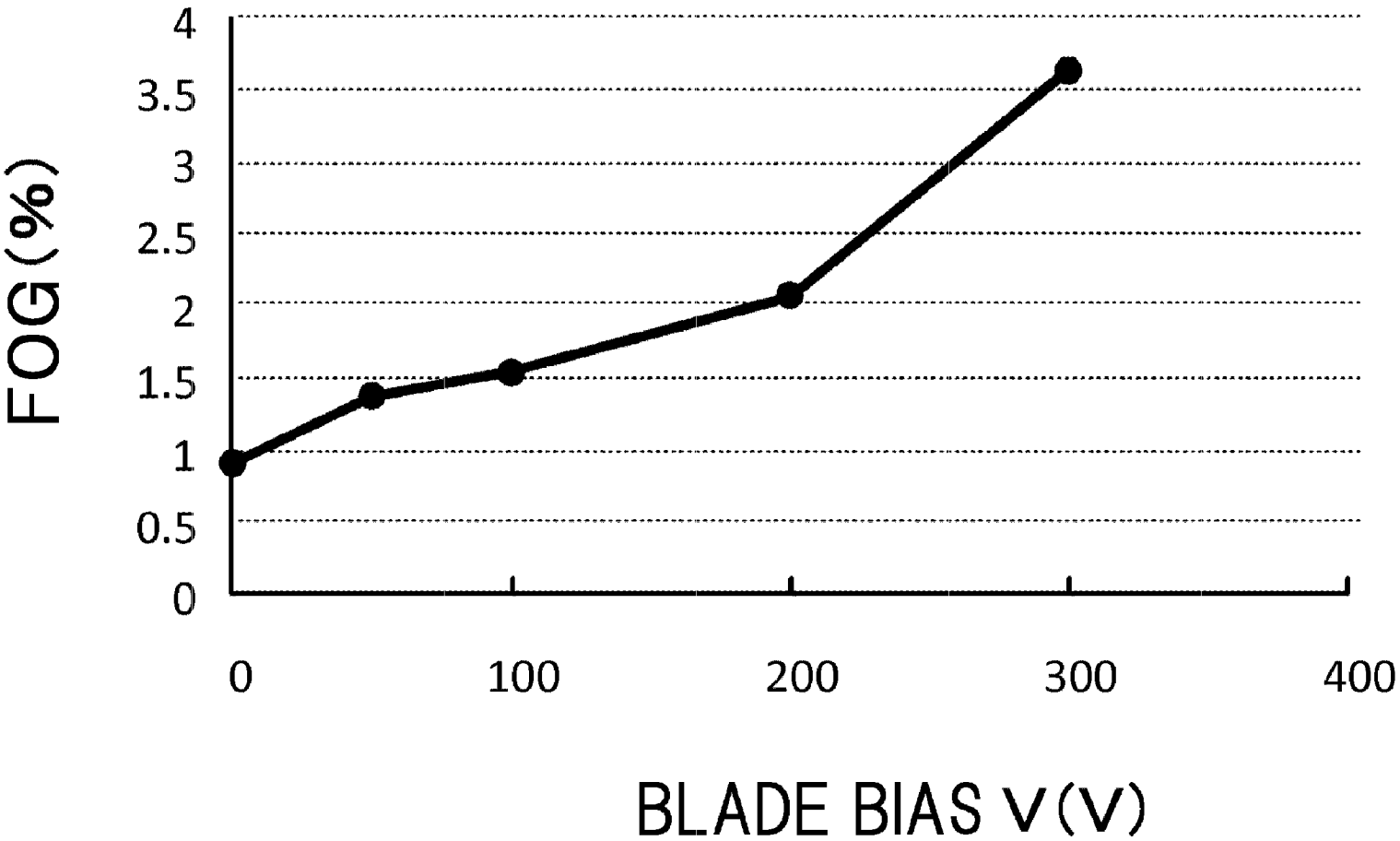
FIG. 3 is a graph showing a dependence of fog on a blade bias V.

FIG. 3 is a graph illustrating the dependence of fog on the blade bias V in relation to the developing roller D. At this time, Vback was set at 200 V. As shown in FIG. 3, fog typically worsens as the blade bias V is increased. As described above, however, the blade bias V must be applied to achieve stable toner coating, and therefore a tradeoff exists between the blade bias V and fog.

<Mechanism for Suppressing Fog>

Figure 4:
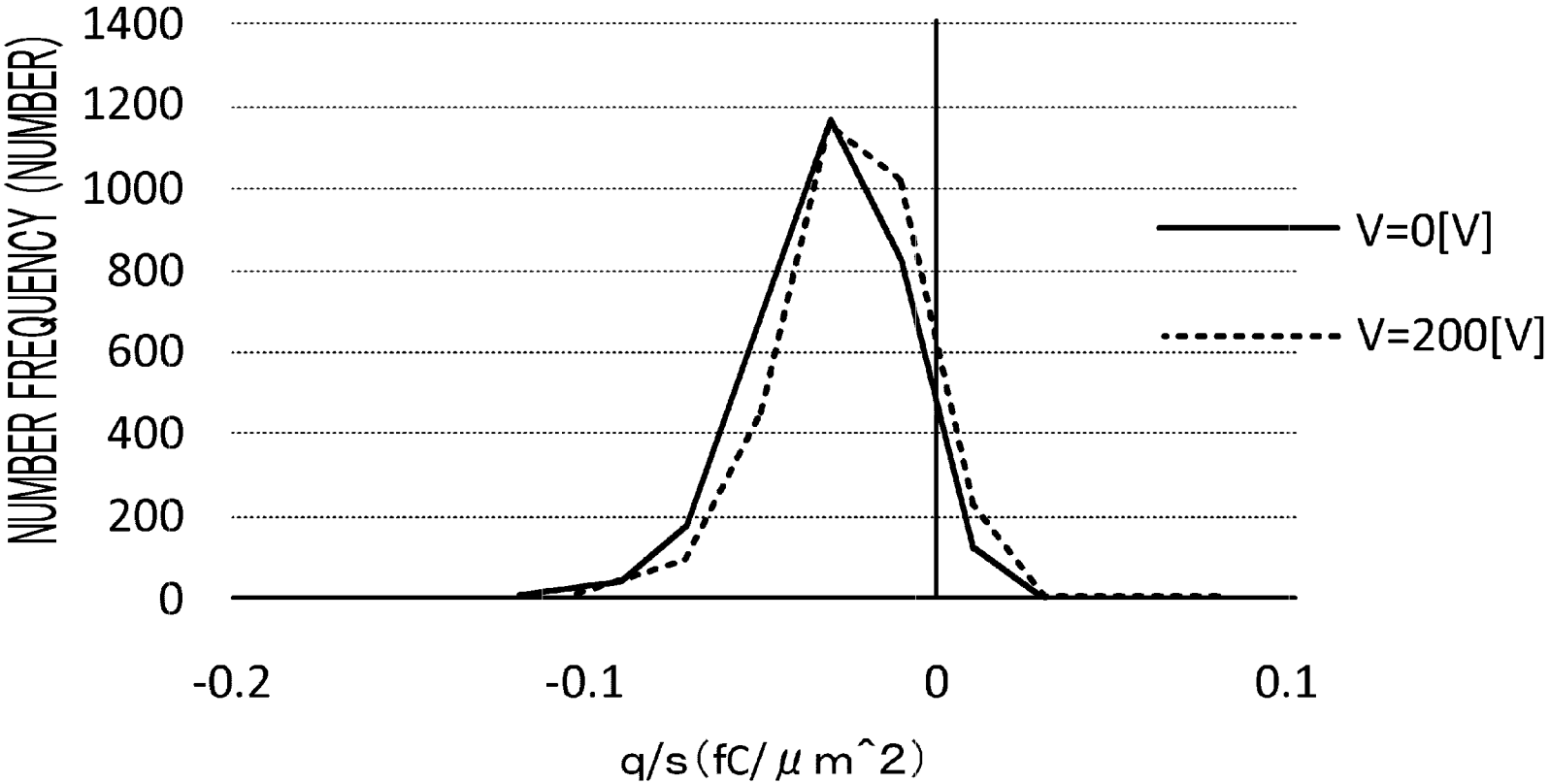
FIG. 4 is a graph comparing charge densities of toner corresponding to differences in the blade bias V.

A mechanism for suppressing fog will be described below. FIG. 4 is a graph comparing the charge density q/s of the toner in accordance with differences in the blade bias V. The charge density q/s of the toner 12 on the developing roller 14 typically decreases as the blade bias V increases. Accordingly, fog is promoted as the blade bias V increases. When a current flowing into the regulating blade 16 and the developing roller 14 is measured at this time, it is found that a normal charge flows into the toner 12 from the regulating blade 16, and the charge of the toner 12 flows to the developing roller 14 side.

The cause of this was considered as follows. When an electric field is applied to the developing roller 14, a surface density of a charge reaching the surface thereof can be approximated by (Equation 4), shown below.

[Math. 4]

$$\left|\frac{VT}{\rho_c d_c}\right| \quad \text{(Equation 4)}$$

By transforming (Equation 4) into (Equation 5), shown below, the significance thereof can be understood. Note that here, I is a current, S is an arbitrary surface area, and Q is a charge amount.

[Math. 5]

$$\left|\frac{VT}{\rho_c d_c}\right| = \left|\frac{IT}{S}\right| = \left|\frac{Q}{S}\right| \quad \text{(Equation 5)}$$

Specifically, the denominator on the left side of (Equation 5) is a sheet resistivity, and by dividing the blade bias V by this sheet resistivity, a current density is obtained. By applying the passage time T through the regulating nip portion N2 to the current density as an approximation of time integration, a surface charge density can be obtained.

Further, it was found that the current flowing into the regulating blade 16 and the developing roller 14 increases dramatically when the developing roller 14 rotates. The reason for this is believed to be that the volume resistance of the toner 12 is large and therefore the charge of the toner 12 moves when the toner 12 rotates so as to contact the developing roller 14. Taking these points into account, when the surface charge density of the developing roller 14 exceeds the surface charge density of the toner 12, contact opportunities for the toner charge increase, and as a result, decay is promoted.

Figure 5A:
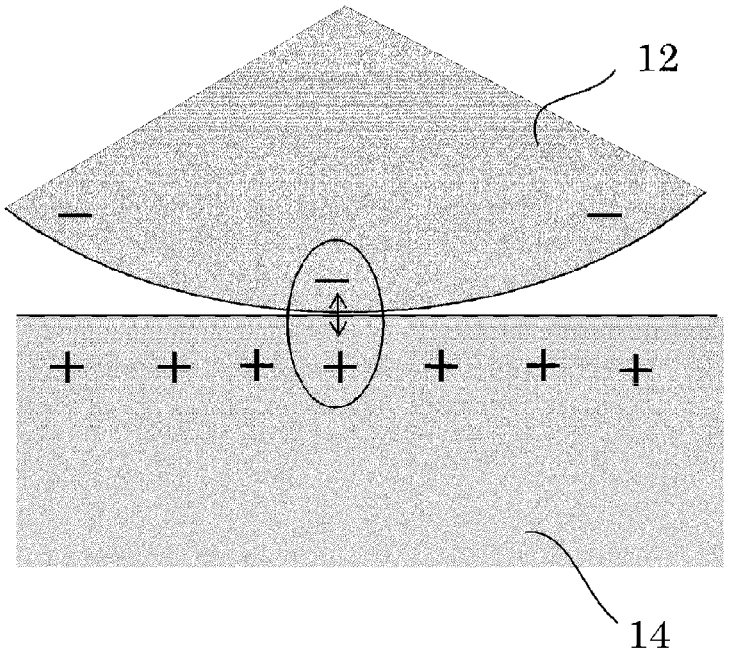
FIGS. 5A and 5B are pattern diagrams illustrating a mechanism of q/s decay.
Figure 5B:
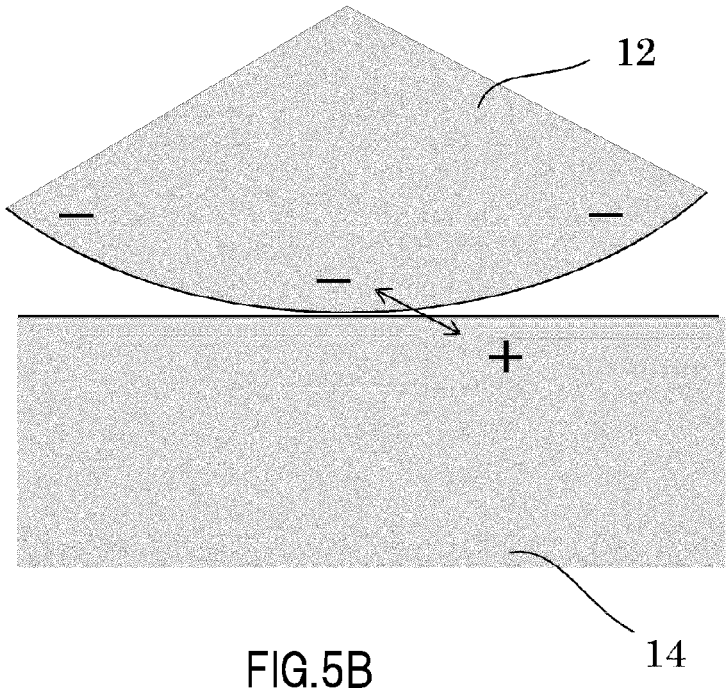

FIGS. 5A and 5B are pattern diagrams illustrating a mechanism by which the toner charge density decays. In a condition shown in FIG. 5A, the surface charge density of the developing roller 14 is higher than the surface charge density of the toner 12, and therefore a recombining charge is likely to exist in a contact region between the toner 12 and the developing roller 14. In a condition shown in FIG. 5B, the surface charge density of the developing roller 14 is lower than the surface charge density of the toner 12, and therefore a recombining charge is unlikely to exist in the contact region between the toner 12 and the developing roller 14. In other words, it is believed that toner charge decay is suppressed by setting the surface charge density of the developing roller 14 at or below the surface charge density of the toner 12.

Accordingly, a relationship between a ratio of the surface charge density of the toner 12 to the surface charge density of the developing roller 14 and the q/s decay rate, given by (Equation 6) shown below, was investigated. The q/s decay rate is obtained by dividing a difference between the q/s of the toner 12 on the developing roller 14 when the blade bias V is set as desired and when the blade bias V is set at 0 V by the q/s of the toner 12 on the developing roller 14 when the blade bias V is set at 0 V. Here, the developing roller D was used, and Vback was set at 200 V.

[Math. 6]

$$\left|\frac{VT}{\rho_c d_c}\right| \Big/ \left|\frac{q}{s}\right| \qquad \text{(Equation 6)}$$

Figure 6A:
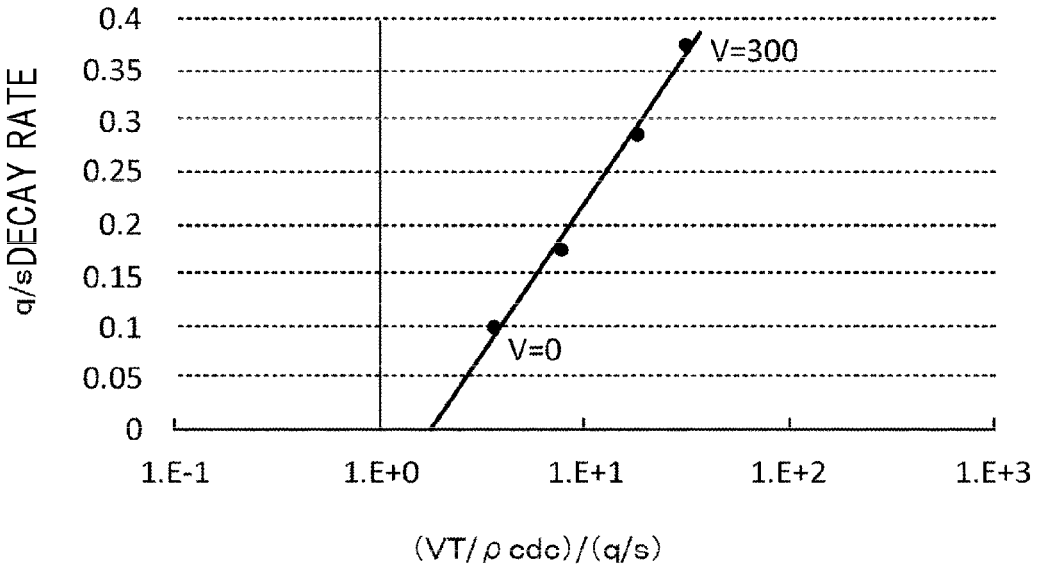
FIGS. 6A and 6B are graphs illustrating the q/s decay.
Figure 6B:
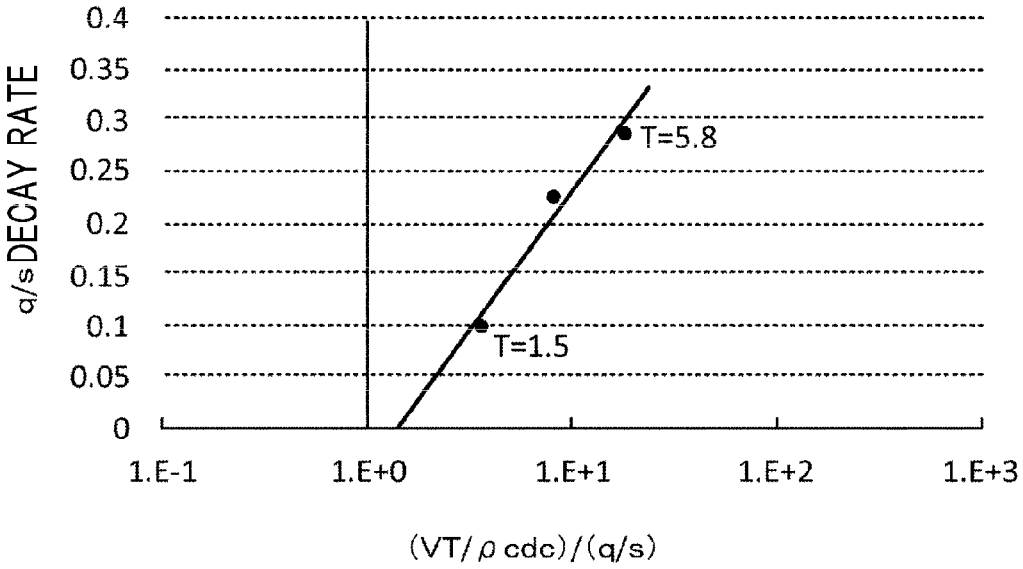
Figure 7A:
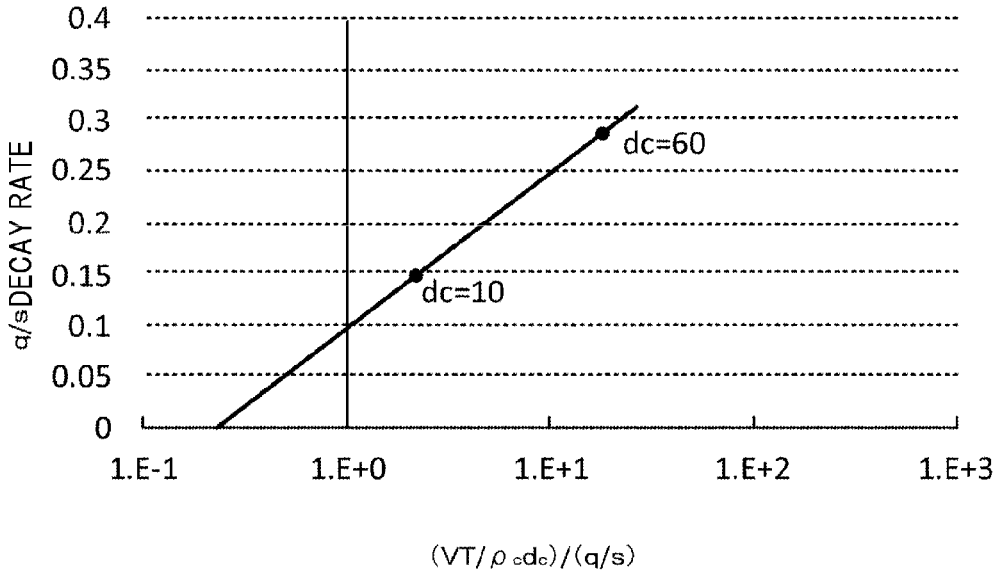
FIGS. 7A and 7B are graphs illustrating the q/s decay.
Figure 7B:
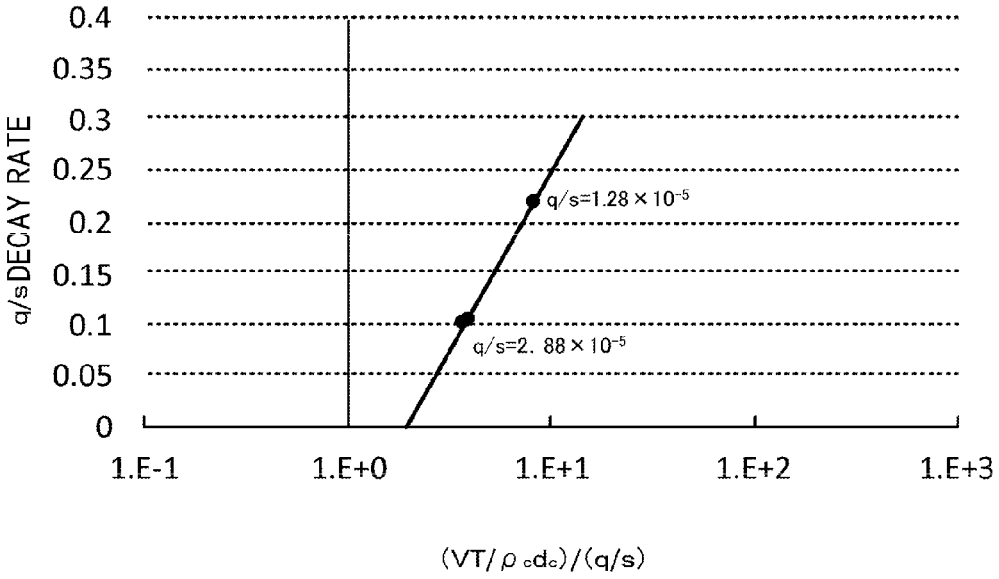
Figure 8:
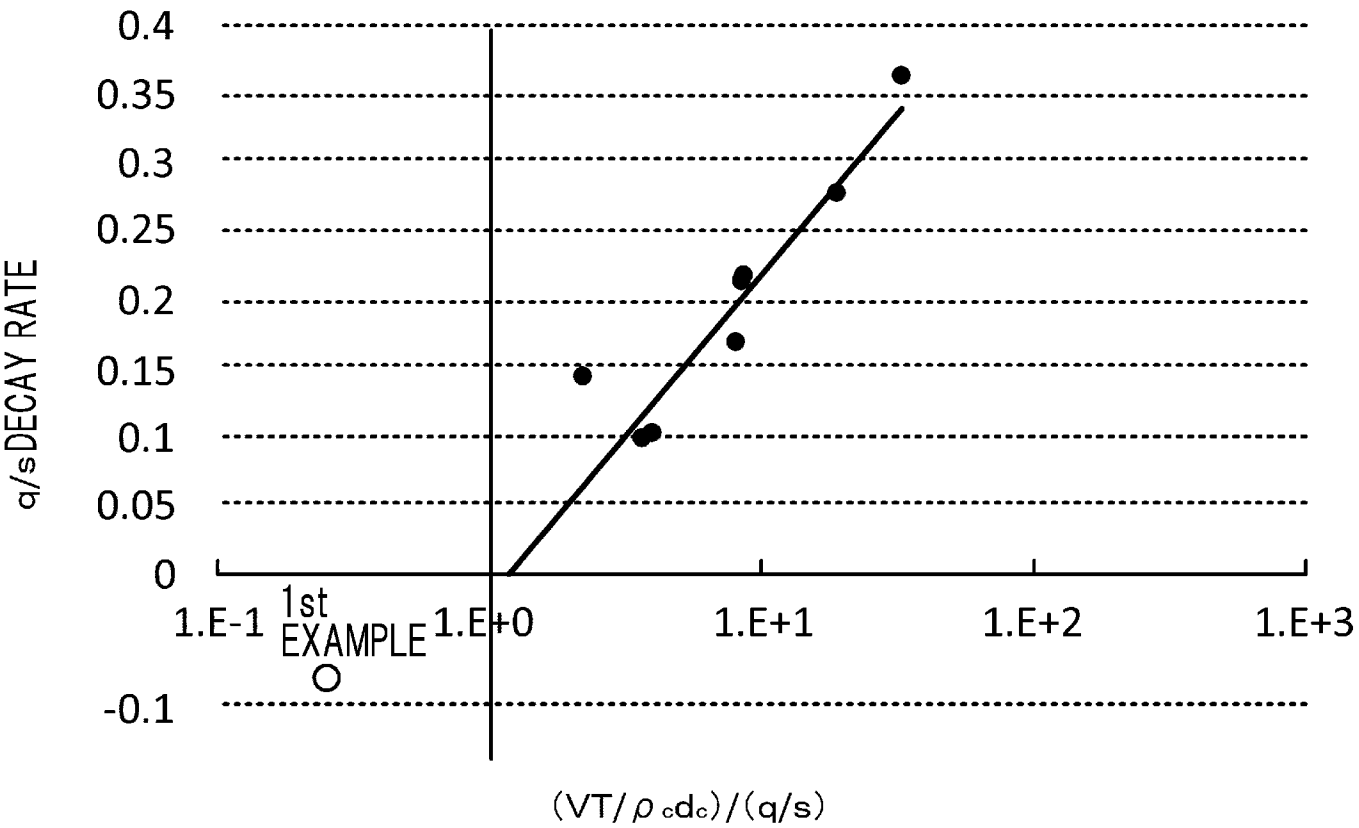
FIG. 8 is a graph illustrating the q/s decay.

Results are shown in FIGS. 6A to 8. FIGS. 6 to 8 are graphs illustrating q/s decay. FIGS. 6A and 6B show results obtained by varying the blade bias V from 0 V to 300 V and varying the passage time T through the regulating nip portion N2 from 1.5 ms to 5.8 ms, respectively. FIGS. 7A and 7B show results obtained by varying the film thickness dc of the surface layer from 10 μm to 60 μm and varying the toner charge density q/s from $1.28\times10^{-5}$ C/m$^2$ to $2.88\times10^{-5}$ C/m$^2$, respectively. FIG. 8 shows these data summarized together with the results of the first example.

It can be seen from FIGS. 6A to 8 that a clear relationship exists between the ratio of the surface charge density of the toner 12 to the surface charge density of the developing roller 14 and the q/s decay rate. Further, it was found that by setting this ratio at or below 1, toner charge decay can be suppressed. The considerations described above can be corroborated by this experiment, and it is therefore evident that by satisfying (Equation 1), decay can be suppressed.

Figure 9:
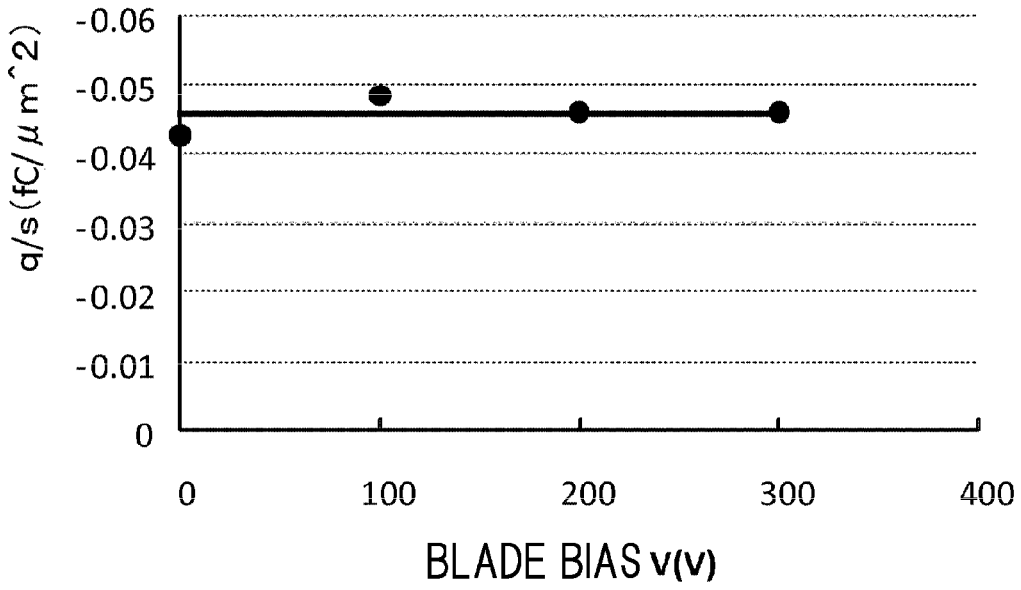
FIG. 9 is a graph showing a q/s decay characteristic of a first example.

FIG. 9 shows a q/s decay characteristic of the first example. As described above, in the developing roller A used in the first example, the ratio between the surface charge densities of the developing roller 14 and the toner 12 is set at or below 1. In other words, (Equation 1) is satisfied, and therefore, as shown in FIG. 9, decay can be suppressed, enabling a dramatic reduction in fog.

Next, the conditions illustrated in (Equation 2) and (Equation 3) shown above, which serve as conditions of the present invention, will be described.

First, (Equation 2) will be described. During the development process, a voltage divided by a dielectric component acts respectively on the toner layer and the developing roller surface layer. An induced charge amount Q at this time is expressed by (Equation 7), shown below.

[Math. 7]

$$Q=C_tV_t=C_cV_c \qquad \text{(Equation 7)}$$

Cc is a capacitance of the surface layer of the developing roller 14, and Vc is a shared voltage of the surface layer of the developing roller 14. Ct is a capacitance of the toner layer on the developing roller 14, and Vt is a shared voltage of the toner layer. When the shared voltage Vc of the surface layer increases beyond the shared voltage Vt of the toner layer, a voltage required for development can no longer be obtained, and therefore the amount of toner that can be developed decreases dramatically, leading to deterioration of the development performance. In other words, to suppress deterioration of the development performance, Vt/Vc>1 must be satisfied. To put it another way, CC/Ct>1 can be obtained from (Equation 7). Further, (Equation 2) can be obtained by establishing a relationship of Cc=∈c∈0S/dc, Ct=∈t∈0S/dt. Here, ∈c is the relative dielectric constant of the surface layer of the developing roller.

The form of d/∈ in (Equation 2) exhibits an electrically equivalent thickness. In other words, when the electrically equivalent thickness of the surface layer is greater than that of the toner layer, the developing characteristic approaches that of the developing roller, and therefore a high voltage is required for development. As a result, a sufficient potential difference cannot be secured between a developed portion and an undeveloped portion, and therefore a tendency to lose clarity on the edge portions of a gray image becomes more striking.

Figures 10A, 10B:
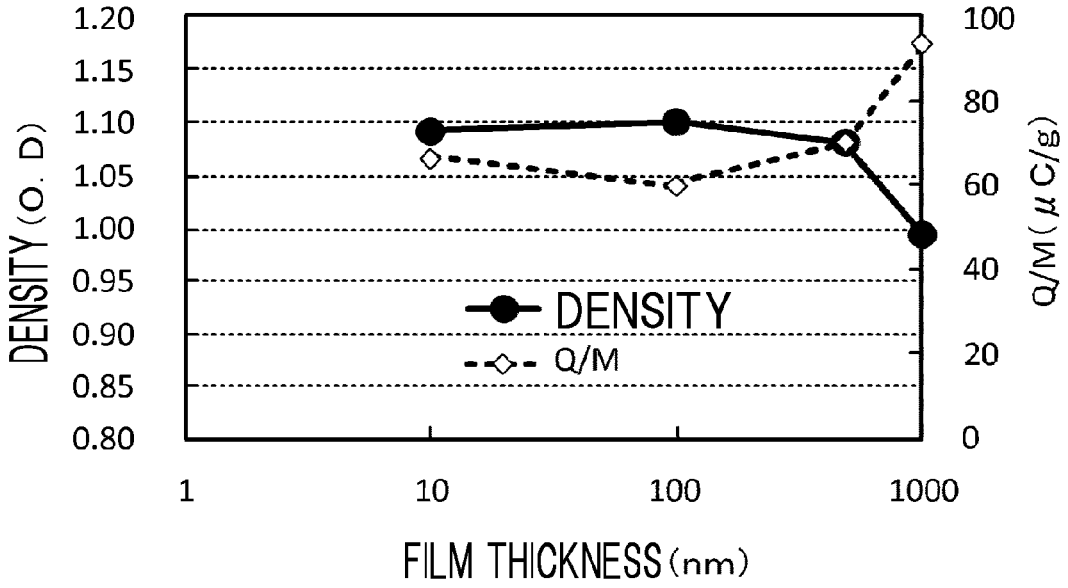
FIGS. 10A and 10B are views showing transitions of a solid density and an average charge amount relative to a film thickness.

Next, referring to FIGS. 10A and 10B, (Equation 3) will be described. (Equation 3) is used to limit the film thickness of the surface layer to a thin layer by generating an appropriate charge leak when the surface layer is charged excessively. FIG. 10 shows transitions of a solid density and an average charge amount Q/M [μC/g] relative to the film thickness. M is a mass [g] of the toner charge. FIG. 10A is a graph showing the transitions of the density and the average charge amount relative to the film thickness, and FIG. 10B is a table showing the density and the average charge amount when the film thickness (nm) is 10, 100, 500, and 1000. The inventors found, through committed research, that if the thickness of the surface layer equals or exceeds 1 μm (1000 nm), a reduction in density may occur even when (Equation 2) is satisfied.

It is evident from FIGS. 10A and 10B that at 1 μm (1000 nm), the charge amount increases dramatically and the density decreases. This phenomenon is believed to occur because the charge amount of the toner layer formed on the developing roller is larger than a charge amount required to compensate for a development contrast (|Vdc−Vl|). In other words, when the surface layer is formed at or above 1 μm, the charge amount of the toner increases dramatically, and therefore the amount of toner applied to the development contrast decreases, leading to a reduction in development efficiency.

The development mechanism described above will now be considered briefly. The Al2O3 surface layer of the developing roller 14 is formed on the surface of the developing roller, which includes an elastic layer, by vacuum deposition using electron beam heating. Meanwhile, the developing roller 14 contacts the regulating blade 16 and the photosensitive drum 1, and therefore a small amount of deformation occurs in the resulting contact regions. It is believed that the surface layer follows this movement, causing fine particle aggregates to form. With a surface layer of less than 1 μm, therefore, toner charge leakage to the developing roller side may occur locally through gaps between the particle aggregates. Further, it is believed that a tunnel current is dominant in the charge movement occurring at this time.

When the surface layer is larger than 1 μm, on the other hand, the developing roller surface layer is almost completely covered thereby, and as a result, charge leakage to the developing roller side is believed not to occur. Furthermore, when the film thickness of the surface layer increases, displacement of the surface layer occurs over a wider range than the contact region, but the amount of deformation in the surface layer itself is small, and therefore fine particle aggregates are less likely to form. As a result, leakage is less likely to occur, leading to a dramatic increase in the charge amount on the toner layer and a reduction in density.

In other words, according to the present invention, by satisfying (Equation 3), a voltage condition required for development is satisfied so that the development performance is maintained, and by setting the film thickness of the surface layer below 1 μm, local leakage is generated such that an excessive increase in the toner charge is suppressed. As a result, the amount of fog can be suppressed dramatically while maintaining the development performance.

As described above, in the first example of the present invention, (Equation 1) is satisfied, and therefore toner charge decay can be suppressed, enabling a reduction in the amount of fog. Further, by satisfying (Equation 2), the voltage required by the developing roller 14 for development can be supplied, and therefore the development performance can be maintained. Moreover, by satisfying the condition of (Equation 3), according to which the film thickness dc of the surface layer of the developing roller 14 is set at less than 1 μm, local leakage is generated such that an excessive charge increase is suppressed. In the first example of the present invention, these conditions are satisfied, and therefore the amount of fog can be suppressed with stability both in a low speed mode, where the amount of fog is likely to increase, and when the number of printed sheets is increased. As a result, image formation can be performed favorably over time.

In the image forming process according to this embodiment, the photosensitive drum 1 performs an operation in a first mode, in which the photosensitive drum 1 is driven to rotate by the image forming apparatus at a rotation speed (a first speed) of 240 mm/sec in the direction of the arrow r in the drawings. The image forming apparatus according to this embodiment also includes the low speed mode (a second mode) in which the process speed is set at 60 mm/sec (a second speed), which is lower than the first speed, in order to secure an amount of heat required to perform fixing during passage of a thick recording sheet (a thick sheet). Note that in this embodiment, operations are performed in only two process modes (the first mode and the second mode), but depending on the thickness of the recording sheet and so on, a plurality of process modes may be provided so that control corresponding to the respective process modes can be executed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-235291, filed on Nov. 13, 2013, which is hereby incorporated by reference herein in its entirety.

What is claimed is:

1. An image forming apparatus comprising:

an image bearing member capable of bearing a developer image that is formed by supplying a developer to a latent image formed on a surface thereof;

a developer carrying member that is provided to be capable of rotating while carrying the developer, and that supplies the developer to the image bearing member by contacting the image bearing member;

a regulating member that regulates a layer thickness of the developer carried on the developer carrying member; and a voltage applying device for applying a voltage to the developer carrying member and the regulating member, wherein the developer carrying member includes a conductive base layer and a surface layer covering the base layer, and when a volume resistance of the surface layer is ρc, a film thickness thereof is dc, and a relative dielectric constant thereof is ∈c, a surface charge density of the developer on the developer carrying member, the film thickness of which has been regulated by the regulating member, is q/s, a relative dielectric constant thereof is ∈t, and a layer thickness thereof is dt, a potential difference between the developer carrying member and the regulating member is V, and a time required for the developer to pass through a contact region between the developer carrying member and the regulating member after entering the contact region as the developer carrying member rotates is T, $$\left|\frac{VT}{\rho_c d_c}\right| \leq \left|\frac{q}{s}\right|$$

$$\frac{d_c}{\varepsilon_c} \leq \frac{d_t}{\varepsilon_t}$$

is satisfied.

2. The image forming apparatus according to claim 1, wherein the film thickness dc is smaller than 1 μm.

3. The image forming apparatus according to claim 1, wherein the image bearing member is provided to be capable of rotating such that a surface movement direction in a contact region with the developer carrying member is identical to a direction of the developer carrying member, and the developer carrying member rotates at a higher rotation speed than the image bearing member.

4. The image forming apparatus according to claim 1, wherein the developer carrying member is provided to be capable of contacting and separating from the image bearing member.

5. The image forming apparatus according to claim 1, wherein the image bearing member includes a first mode for rotating at a first speed and a second mode for rotating at a second speed that is higher than the first speed.

6. The image forming apparatus according to claim 1, wherein the developer is a single component non-magnetic toner.

7. The image forming apparatus according to claim 1, wherein the surface layer is formed from alumina.

* * * * *